US005690252A

United States Patent [19]

Oleksiewicz et al.

[11] Patent Number: 5,690,252

[45] Date of Patent: Nov. 25, 1997

[54] VERSATILE DISPENSING SYSTEMS

[75] Inventors: Beata Maria Oleksiewicz, Downers Grove; Michael J. Rocheleau, Prairie View, both of Ill.

[73] Assignee: Fluid Management Limited Partnership, Wheeling, Ill.

[21] Appl. No.: 545,982

[22] Filed: Oct. 20, 1995

[51] Int. Cl.[6] ..... B67D 5/08

[52] U.S. Cl. ..... 222/56; 141/104; 222/144.5; 285/137.1

[58] Field of Search ..... 141/83, 104; 285/30, 285/137.1, 137.2; 222/56, 77, 55, 64, 144.5, 144, 132; 239/548

[56] References Cited

U.S. PATENT DOCUMENTS

| | | | |
|---|---|---|---|
| 2,923,438 | 2/1960 | Logan et al. | 141/104 X |
| 3,349,815 | 10/1967 | De Baets | 141/104 X |
| 4,137,954 | 2/1979 | Brill et al. | 141/90 |
| 4,440,315 | 4/1984 | Slobodnik | 222/56 |
| 4,759,462 | 7/1988 | Neglio | 285/137.1 X |
| 4,850,514 | 7/1989 | Scholl et al. | 222/146.5 |
| 4,852,604 | 8/1989 | Wales et al. | 222/56 X |
| 5,078,302 | 1/1992 | Hellemberg | 222/144.5 X |
| 5,129,551 | 7/1992 | Gott | 222/135 |
| 5,328,057 | 7/1994 | Hellenberg et al. | 222/144.5 X |
| 5,368,196 | 11/1994 | Hellenberg et al. | 222/61 |
| 5,474,211 | 12/1995 | Hellenberg | 222/144.5 X |
| 5,493,840 | 2/1996 | Cane | 141/104 X |

FOREIGN PATENT DOCUMENTS

| | | | |
|---|---|---|---|
| 0 176 140 A2 | 4/1986 | European Pat. Off. | B01F 15/04 |
| 0 283 137 B1 | 4/1992 | European Pat. Off. | B05B 1/32 |

*Primary Examiner*—Kevin P. Shaver

*Attorney, Agent, or Firm*—Fitch, Even, Tabin & Flannery

[57] ABSTRACT

A dispensing system utilizes a nozzle assembly including a nozzle block defining a series of recesses for receiving dispense nozzles. A resilient clamp is inserted between the nozzles and compressed so as to expand, clamping the nozzles in position. A fill control is also disclosed.

20 Claims, 8 Drawing Sheets

VERSATILE DISPENSING SYSTEMS

BACKGROUND OF THE INVENTION

1. Field of the Invention

The present invention pertains to dispensing systems, and in particular to dispensing systems for accurately metering the components of a blended composition.

2. Description of the Related Art

Automated dispensing systems are oftentimes designed to be used with a selected family of materials, and the prospect of encountering incompatible materials is usually not expected. For example, paint dispensing systems are employed to meter tinting materials and additives for blending with a paint base according to different color formulas. Dispensing accuracy is carefully controlled with dedicated equipment, and depends on the predictable, compatible nature of the materials being dispensed.

However, there are a growing number of commercially important systems which require a greater flexibility. For example, nutraceuticals and other food grade products are now being dispensed on a high volume basis. Such dispensing also requires carefully controlled metering accuracy, but with a wide variety of different material types. Unlike paint systems which have similar types of components, nutraceuticals often contemplate materials which might have different solvents or which are otherwise incompatible with one another. Dispensing systems for these food-grade compositions must be adaptable for change-over to different families of materials and must also meet rigorous cleaning requirements.

Dispensing systems require different constructions due to factors directly relating to the total quantities of materials dispensed. For example, many tint dispensers used in the paint industry have canisters carried on board the machine for storing the materials to be dispensed. These arrangements have been found satisfactory for many commercial applications since the tint materials are sufficiently concentrated so as to require only infrequent replenishing of the canister contents. However, larger scale industrial applications require storage vessels at least as large as the dispensing equipment, and oftentimes many times larger than the dispensing equipment. Occasionally, very large scale production facilities have remotely located storage vessels of very large capacity, located remote from the dispensing site. While materials could be withdrawn from such very large vessels using conventional techniques, improved, simplified systems are being sought.

SUMMARY OF THE INVENTION

It is an object of the present invention to provide dispensing systems which are adaptable so as to readily accommodate different types of materials.

Another object of the present invention is to provide dispensing systems of the above-described type which are readily reconfigurable to provide extra precautions against mingling of components.

Yet another object of the present invention is to provide dispensing systems of the above-described type having improved fill controls for vessels holding batch quantities of materials.

These and other objects according to principles of the present invention are provided in a dispensing system for delivering a plurality of materials, comprising:

a plurality of vessels having sidewalls with upper and lower ends;

spaced-apart pairs of mounting lugs protruding from the vessels;

a support frame for receiving the vessels and for engaging the mounting lugs so as to hangingly support the vessels;

a plurality of weight indicating means for sensing the vessel weights, located between at least one of the mounting lugs of the vessels and the support frame and the weight indicating means having output means indicative of the weights sensed;

flow control means having control input means coupled to the output means of the weight indicating means, material input means for receiving material to fill the vessels and material output means for coupling the vessels and the material source;

coupling means coupling the output means of the weight indicating means and the input means of the flow control means whereby filling of the vessels is controlled by the weight indicating means;

a body having upper and lower spaced surfaces and defining a central aperture extending between the upper and the lower surfaces and a plurality of trough-like recesses surrounding the central aperture and extending between the upper and the lower surfaces;

a plurality of dispense nozzles coupled to the vessels and having end portions at which material is dispensed, the end portions disposed in the recesses; and a resilient clamping member having an outer surface, the clamping member disposed in the central aperture and dimensioned so that portions of the outer surface engage the dispense nozzle end portions so as to clamp the dispense nozzle end portions in the body.

Other objects of the present invention are provided in a nozzle assembly, comprising:

a body having upper and lower spaced surfaces and defining a central aperture extending between the upper and the lower surfaces and a plurality of trough-like recesses surrounding the central aperture and extending between the upper and the lower surfaces;

a plurality of dispense nozzles having end portions at which material is dispensed, the end portions disposed in the recesses; and a resilient clamping member having an outer surface, the clamping member disposed in the central aperture and dimensioned so that portions of the outer surface engage the dispense nozzle end portions so as to clamp the dispense nozzle end portions in the body.

Further objects of the present invention are provided in a fill control system, comprising:

a vessel having a sidewall with upper and lower ends;

a spaced-apart pair of mounting lugs protruding from the vessel;

a support frame for receiving the vessel and for engaging the mounting lugs so as to hangingly support the vessel;

weight indicating means for sensing the vessel weight, located between at least one of the mounting lugs and the support frame and the weight indicating means having output means indicative of the weight sensed;

a material source of material to fill the vessel;

flow control means having input means and coupling the vessel and the material source;

coupling means coupling the output means of the weight indicating means and the input means of the flow control means whereby filling of the vessel is controlled by the weight indicating means.

DETAILED DESCRIPTION OF THE PREFERRED EMBODIMENTS

Figure 1:
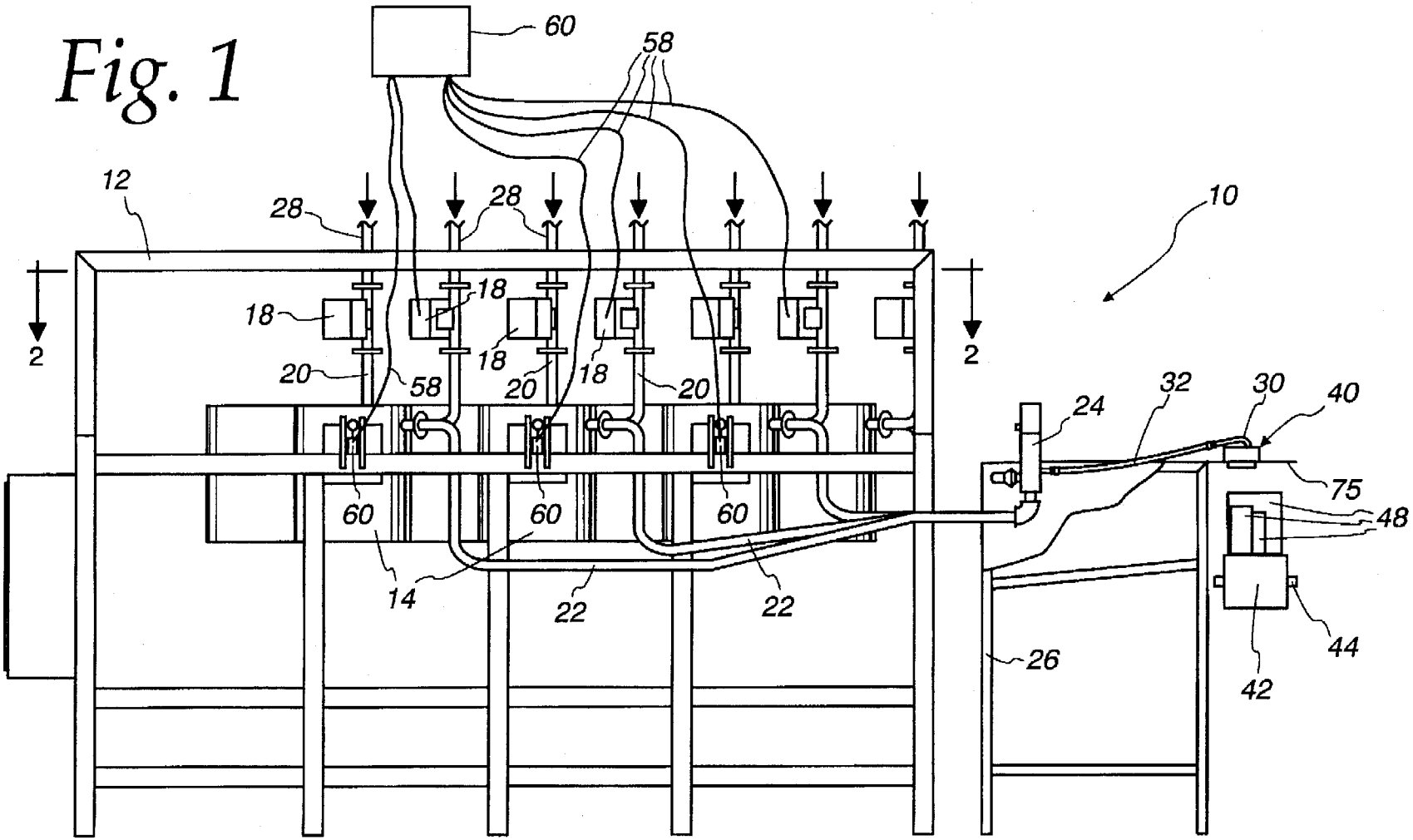
FIG. 1 is a side elevational view of a dispensing system according to principles of the present invention.
Figure 2:
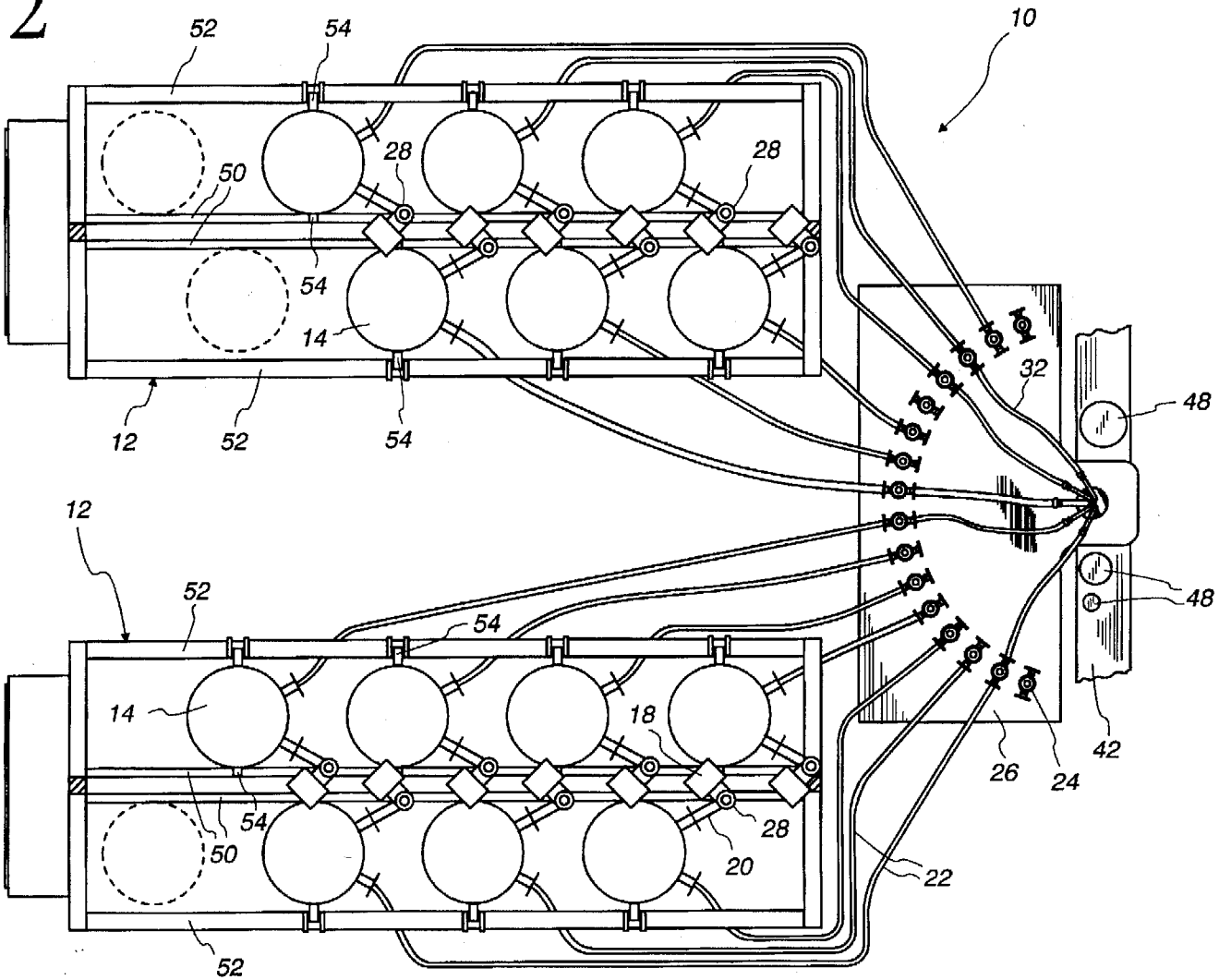
FIG. 2 is a cross-sectional view taken along the line 2—2 of FIG. 1.

Referring now to the drawings, and initially to FIGS. 1 and 2, a dispensing system is generally indicated at 10. The dispensing system includes a framework 12 on which a plurality of vessels 14 are mounted. Each vessel is coupled to a flow controller 18 by conduits 20. Conduits 22 connect the vessels 14 to dispense valves 24 mounted on an adjacent frame 26. Conduits 28 couple the flow controllers 18 to material reservoirs (not shown). Pumps 24 are coupled to respective dispense nozzles 30 by flexible lines 32. As will be seen herein, the dispense nozzles 30 are mounted in a mounting assembly generally indicated at 40. A conveyor 42 travels along tracks 44 and carries a plurality of different sized cans 48 or other suitable containers underneath the dispense nozzles. Accordingly, a plurality of different materials entering dispense system 10 through conduits 28 can be selectively dispensed in cans 48.

Referring to FIG. 2, a pair of frames 12 are provided to accommodate a larger number of fluids to be dispensed. Each frame 12 includes two staggered rows of vessels 14, the vessels being hangingly suspended between interior rails 50 and exterior rails 52. The vessels are preferably comprised of open-top hollow members having a pair of mounting lugs 54 at their upper ends, so that the vessels 14 can be hangingly suspended from rails 50, 52. As will be seen herein, the weight of the hanging vessel is monitored so that the vessels 14 can be "topped off" at appropriate times. In the preferred embodiment, the vessels 14 are of relatively small size compared to the external reservoirs coupled to the dispensing system by conduits 28. Accordingly, the dispensing system is particularly advantageous in a large production setting.

Figure 3:
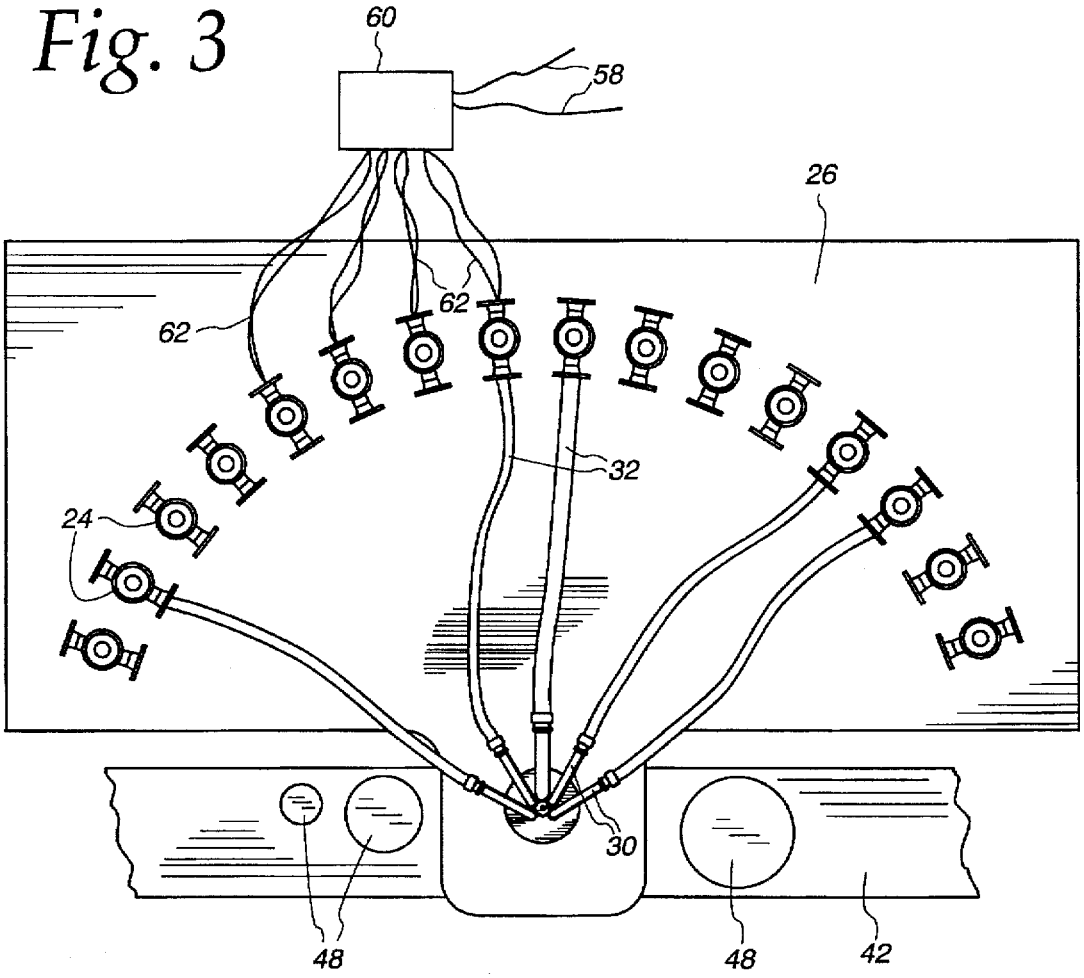
FIG. 3 is a fragmentary view showing a portion of the dispensing system of FIG. 2 on an enlarged scale.
Figure 4:
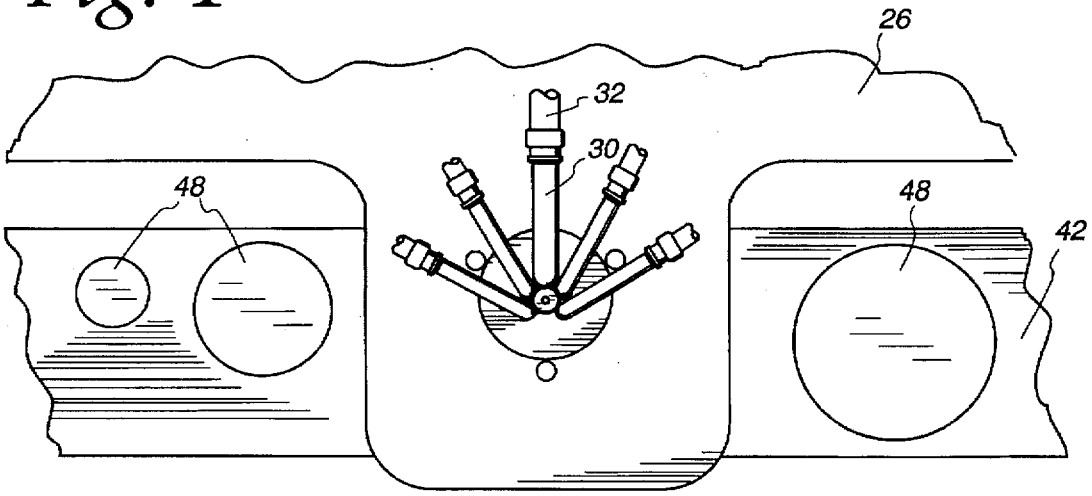
FIG. 4 is a fragmentary view showing a portion of FIG. 3 on an enlarged scale.

Referring additionally to FIGS. 3 and 4, the dispense valves 24 are arranged along a circular arc on frame 26. As can be seen in FIG. 3, the flexible coupling lines 32 can be made of equal length, thereby reducing set-up error. As can also be seen in FIG. 3, the flexible couplings 32 and dispense nozzles 30 can be made of different cross-sectional sizes, allowing greater quantities of material to be dispensed in an optimally shortened dispense cycle. The dispensing system preferably includes remotely controlled dispense valves coupled to a common controller 60 through control lines 62. The controller 60 and control lines 62 are of conventional design and could be electrical, pneumatic or hydraulic, as desired.

Figure 18:
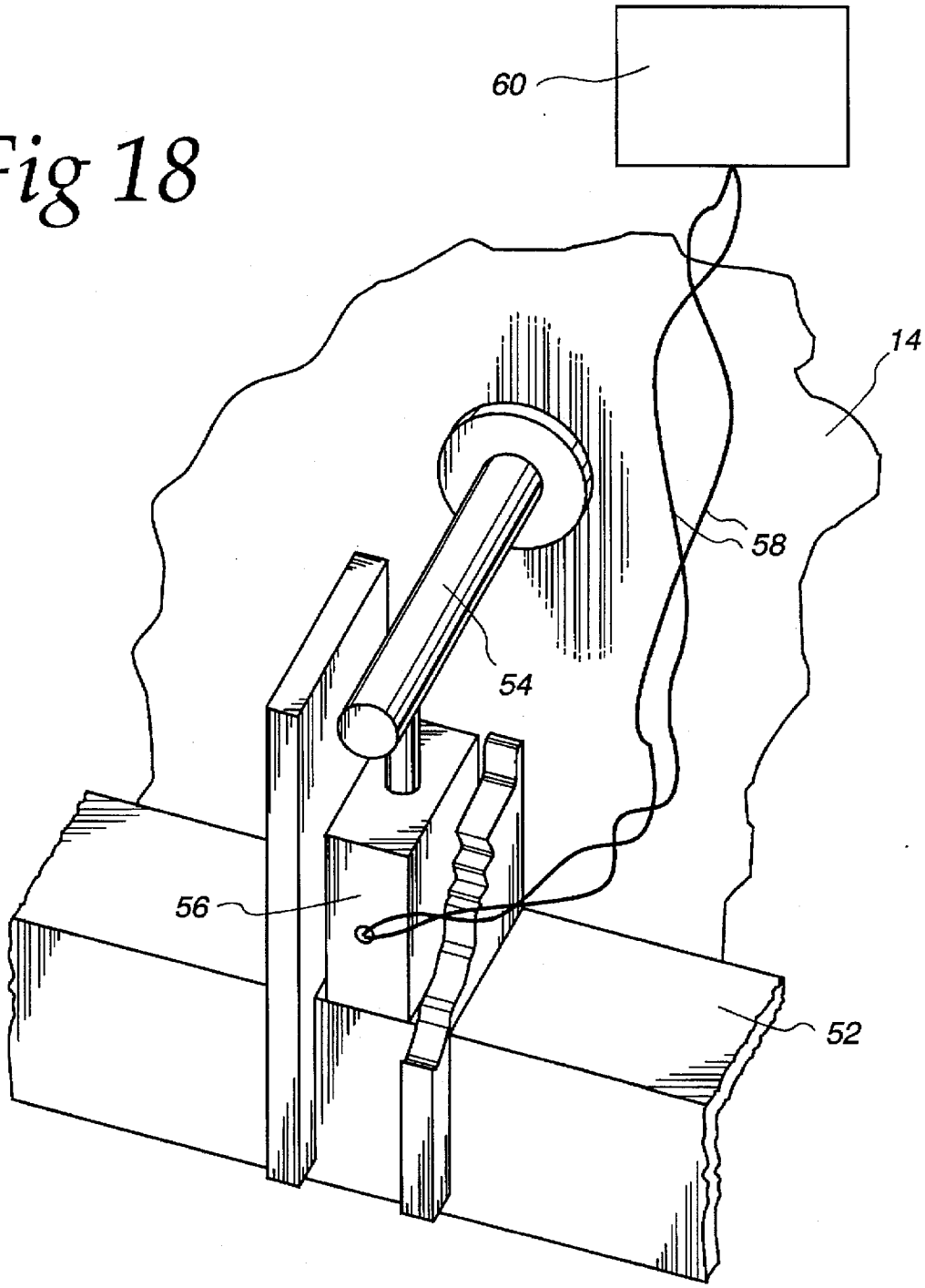
FIG. 18 is a fragmentary perspective view showing a portion of the dispensing system of FIG. 1 in greater detail.

Referring to FIGS. 1 and 18, a weight sensor 56, preferably in the form of a strain gauge having output conductors 58, is interposed between the mounting lugs 54 and support rail 52. Signals indicating the weight of vessel 14 are transmitted through conductors 58 to controller 60. The strain gauge senses weight change and changes signal 58 to controller 60. Controller 60 then controls flow via controllers 18. The flow controllers 18 respond to signals in conductors 58 to couple inlet conduits 28 to vessels 14 so as to introduce additional material into the vessels. As mentioned, the vessels 14 in the preferred embodiment provide an intermediate holding capacity, being fed through conduits 18 by much larger remote vessels, too large to be located on the production floor adjacent the dispense nozzles. As will be appreciated, the flow controllers 18 can be programmed for different operating conditions. For example, the strain gauge can sense a drop in weight of vessels 14, with signal controller 60 opening the associated control valves to "top off" the vessels 14 so as to maintain liquid levels in the vessels at a fairly constant level.

The flow controllers 18 are coupled to controller 60 so as to avoid filling the vessels 14 during a dispense operation, if this is found to be desirable. Accordingly, the vessels 14 can be managed to provide relatively constant flow conditions by maintaining the weight in vessels 14 relatively constant. In addition, the controller 60 can trigger an alarm associated with flow controllers 18 if an overweight condition is present, indicative of a fill control malfunction. Further, if desired, flow controller 18 can include volumetric flow measuring devices, the output data of which can be correlated with weight measurements from sensors 56 to indicate a change in material density. Further, controller 60 can monitor the change in weight indicated by sensor 56 to detect a loss of pressure in inlet conduits 28 indicating, for example, that the main reservoir has been emptied.

Figure 10:
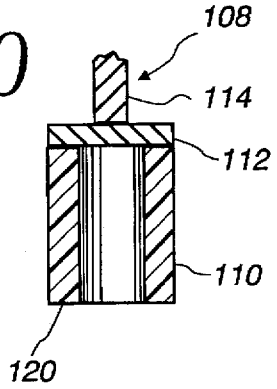
FIG. 10 is a cross-sectional view of the resilient clamping member shown in FIG. 7, in a relaxed state.
Figure 11:
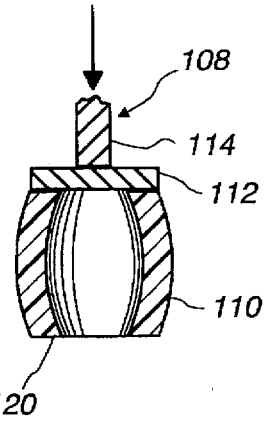
FIG. 11 shows the resilient clamping member of FIG. 10 in a compressed state.
Figure 12:
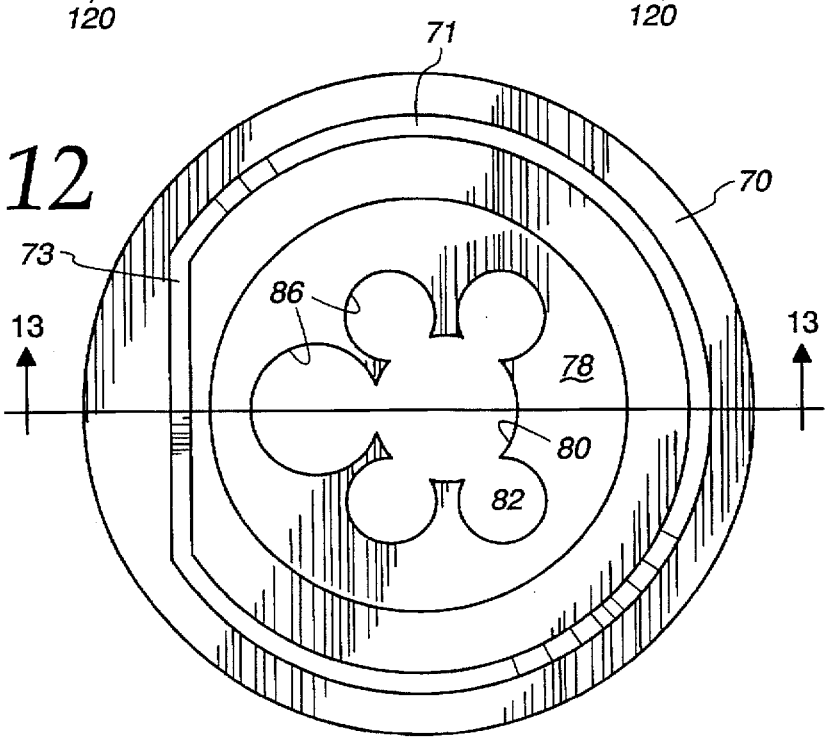
FIG. 12 is a bottom plan view of the mounting block of FIG. 8.

Turning now to FIGS. 5–12, a plurality of nozzles 30 are suspended above conveyer 42 in the mounting assembly generally indicated at 40. The mounting assembly 40 includes a mounting block 70 having opposed upper and lower surfaces 72, 74, respectively. As can be seen in FIG. 12, the mounting block 70 can be provided with a bottom wall 71 having a flat portion 73 for orienting the mounting block at a preselected angular position, within a mounting surface, such as a mounting plate 75 (see FIG. 1).

Figure 7:
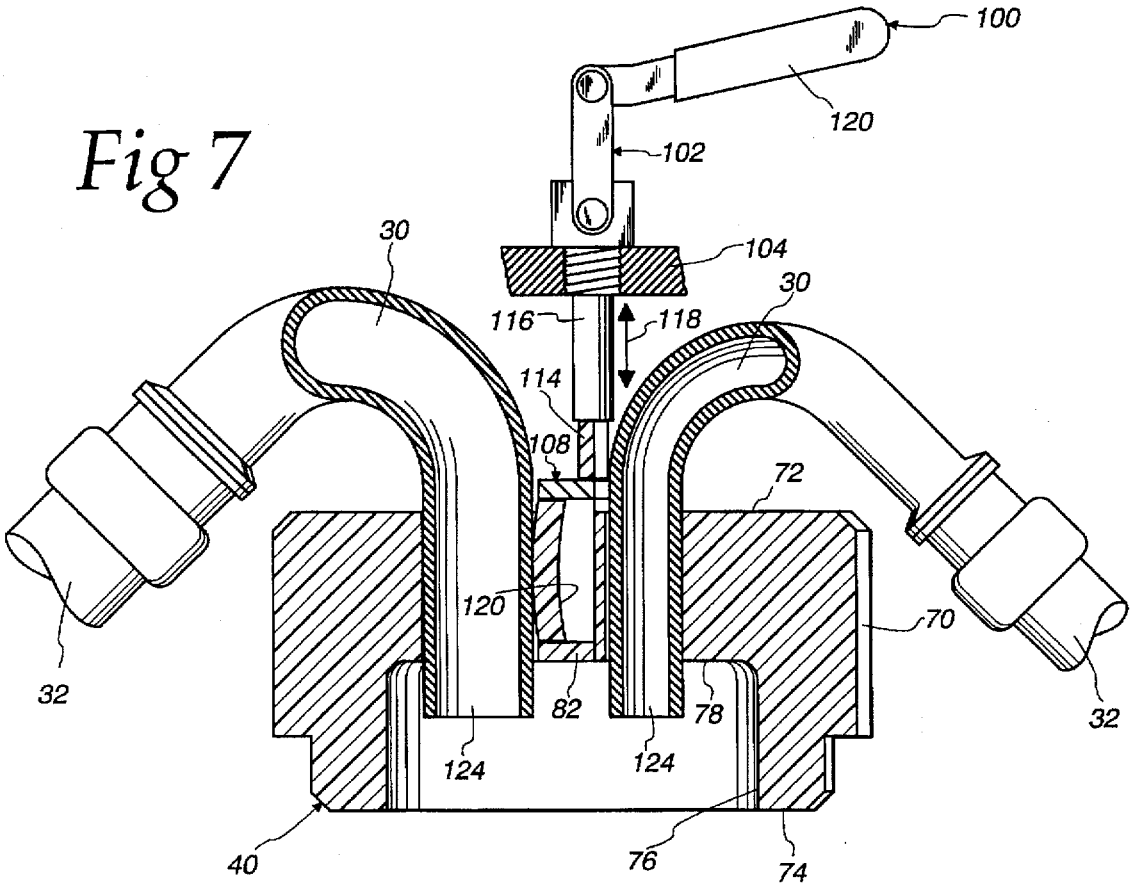
FIG. 7 is a cross-sectional view taken along the line 7—7 of FIG. 6.
Figure 8:
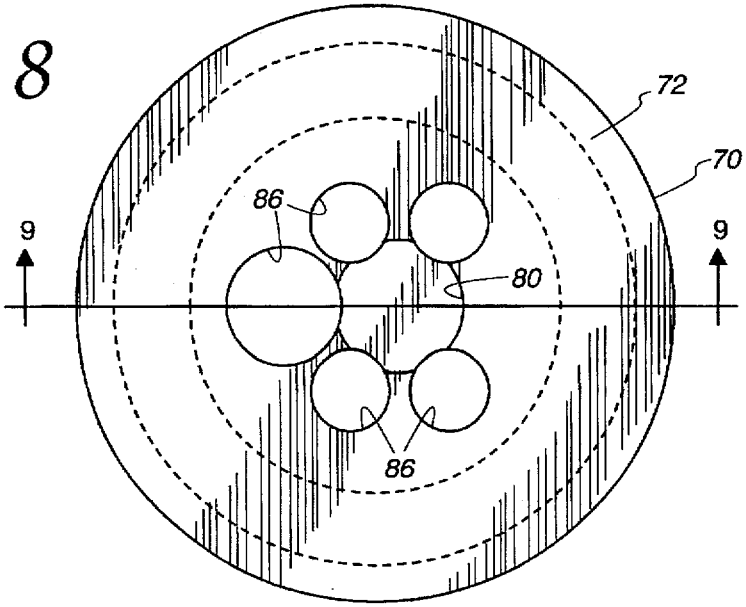
FIG. 8 is a top plan view of the mounting block thereof.
Figure 9:
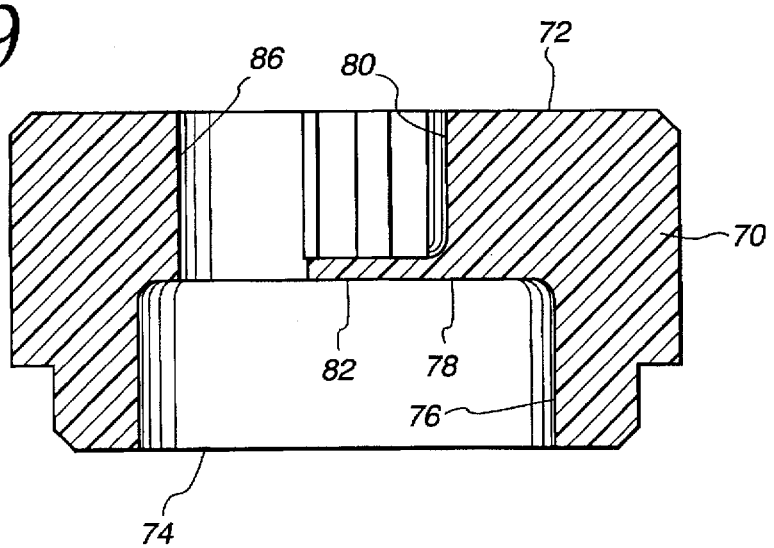
FIG. 9 is a cross-sectional view taken along the line 9—9 of FIG. 8.

As can be seen in FIG. 7, for example, a counterbore 76 is formed in the bottom end of the mounting block so as to shield the nozzle tips from inadvertent contact as a series of cans are conveyed underneath. The counterbore 76 extends from the lower surface 74, terminating at an internal wall 78, which is preferably generally parallel to the upper surface 72. FIGS. 8, 9 and 12 show the mounting block 70, separate from the dispense nozzles 30 and remainder of mounting assembly 40. A "central" aperture 80 is formed in block 70. Preferably, aperture 80 is a blind aperture, and does not extend through the mounting block 70, but rather stops short of internal wall surface 78, being separated therefrom by an end wall 82. A plurality of trough-shaped recesses 86 are formed around aperture 80 and, as can be seen in FIGS. 8 and 12, are spaced apart from one another.

While the central aperture 80 is shown somewhat larger than the largest recess 86, it may be proportionally larger or smaller, as required. The trough-shaped recesses 86 are preferably part cylindrical in shape. Preferably, the recesses 86 have openings 88 communicating with central aperture 80 (see FIG. 12). Further, while the openings 88 for each recess are relatively small, comprising only a small fraction of the circular cross section of the cylindrical recesses, relatively smaller or larger openings may be utilized. However, it is generally preferred that the recesses receive at least half of the cross-sectional size of the nozzles inserted in mounting block 70. In the preferred embodiment, the resilient body is formed with a maximum outer diameter, in its relaxed state, of a diameter less than the diameter of central aperture 80. Preferably, the maximum diameter of their resilient body ranges between 80 and 95 percent, and most preferably between 82 and 88 percent of the diameter of central aperture 80.

Figure 5:
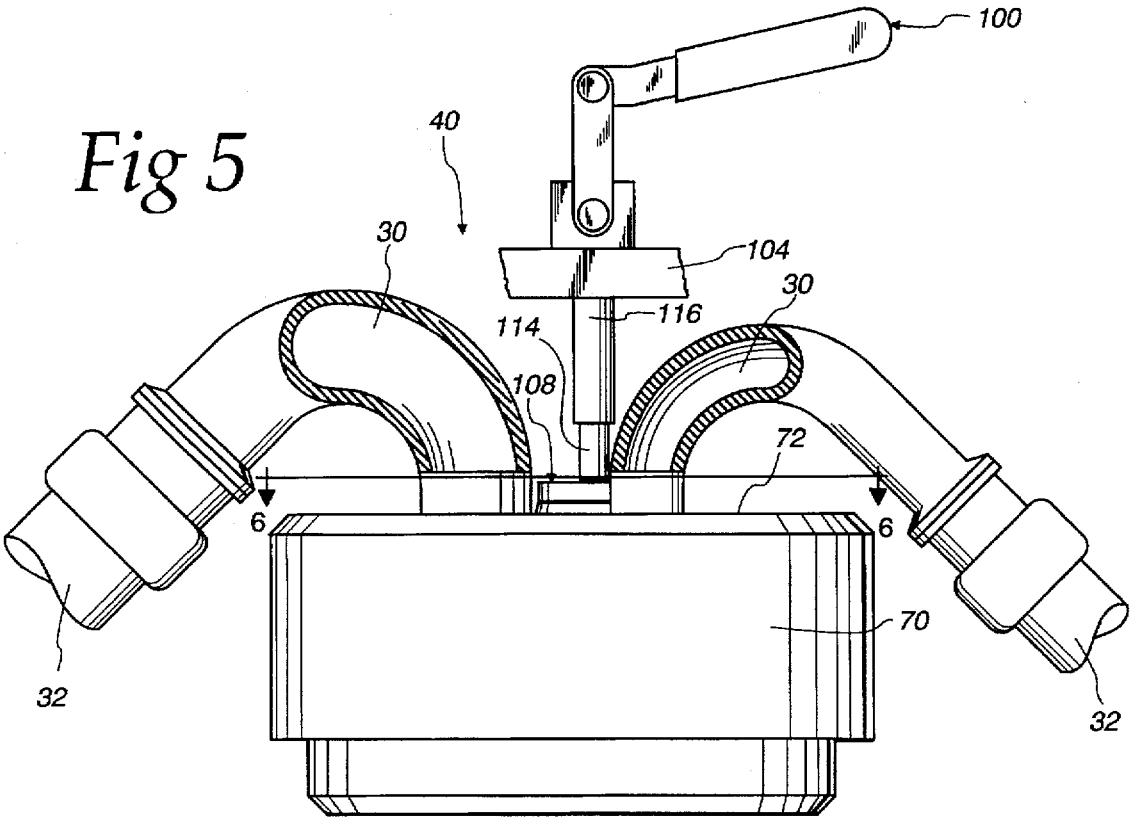
FIG. 5 is a fragmentary front elevational view of mounting apparatus according to principles of the present invention.

Referring to FIGS. 5, 7 and 10, mounting assembly 40 includes a clamping assembly generally indicated at 100. The clamping assembly 100 includes a toggle actuator, generally indicated at 102, mounted on a support plate 104 and a resilient clamping member generally indicated at 108. Referring additionally to FIG. 10, the resilient clamping member includes a resilient body 110 which is generally cylindrical, a rigid plate 112 and a mounting stem 114. As indicated in FIG. 7, the toggle actuator 102 includes a plunger 116 which is moved back and forth in the directions of arrow 118, by manipulating handle 120. The resilient clamping member 108 is inserted within the blind recess 80 of mounting block 70, with its lower free end 120 pressing against internal wall 82. FIG. 10 shows the resilient clamping member 108 in a relaxed state. As mentioned, the resilient body 110 is preferably cylindrical, although other shapes are also possible. FIG. 11 shows the outwardly bulging shape of resilient body 110 when placed under compression which is applied to the resilient clamping member by toggle actuator 102.

Figure 6:
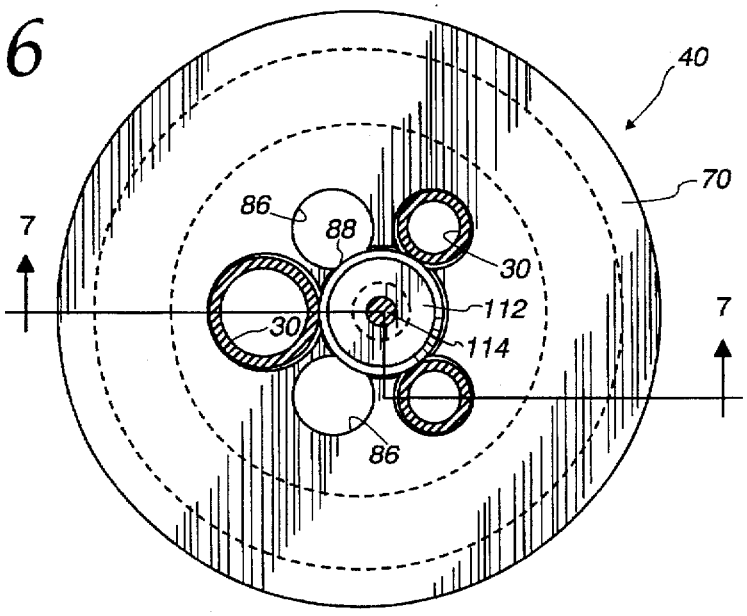
FIG. 6 is a cross-sectional view taken along the line 6—6 of FIG. 5.

As indicated in the FIGURES, a plurality of nozzles are inserted within mounting block 70. The nozzles preferably have a cylindrical shape which is bent to form an angle significantly less than 90°, and most preferably less than 45°, although other nozzle shapes and cross-sectional configurations can be employed. With the nozzles inserted in recesses 86, the resilient clamping member 108 is inserted in the central aperture 80. As indicated in FIG. 6, nozzles inserted in recesses 86 protrude through the openings 88 so as to enter the central aperture 80.

In the preferred embodiment, the resilient body 110 is dimensioned so as to lightly engage the nozzles 30 inserted in mounting block 70 when uncompressed. Referring to FIG. 7, this results in a slight frictional engagement which temporarily holds the nozzles 30 at a fixed position relative to the nozzle block, and especially the interior end wall 78 of the preferred nozzle block 70. Since the resilient body is self-centering, the need for pilot holes or locating pins is avoided. The nozzles can thereafter be adjusted with respect to the valve assemblies 24 and further the relative vertical positioning of the nozzles within mounting block 70 can be adjusted. It is preferred that the lower free ends or orifices 124 of nozzles 30 be aligned at a uniform distance from internal wall 78 of the mounting block from which the free ends of nozzles 30 extend. When the nozzles are aligned at their desired positions, handle 120 is then manipulated to compress resilient body 110 in the manner illustrated in FIGS. 7 and 11, for example, to clamp the nozzles in position within mounting block 70. Thus, the clamping arrangement provides both orientation and clamping force for each particular configuration of nozzles installed in mounting block 70, eliminating the need for separate orienting and clamping systems. When handle 120 is actuated to compress the nozzles within mounting block 70, the nozzles are maintained rigid enough to prevent their vibration caused by any pressure pulses that may be transmitted through the fluid lines so as to potentially cause drops of uncontrolled size to fall from the nozzle orifices 124.

As mentioned, it is possible to reposition the nozzles located in mounting head 70. In particular, the nozzles can swivel to face the particular dispense valve that the nozzle is connected to, before the plunger is actuated to clamp the nozzle within the mounting block. The ability to point the various dispense nozzles toward their respective dispense valves allows the tubing lengths to be made equal, and as short as practically possible. Further, the mounting blocks can be configured so as to line up individual nozzles directly with their appropriate supply valve, thus eliminating the need for additional bends and excess length in the interconnecting tubing 30.

Figure 16:
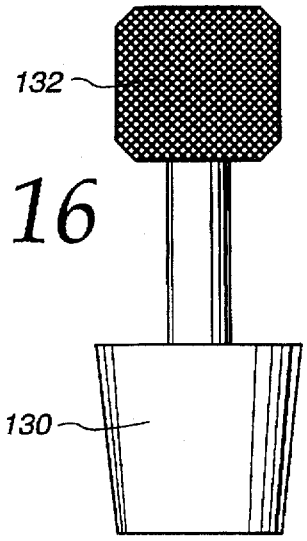
Figure 17:
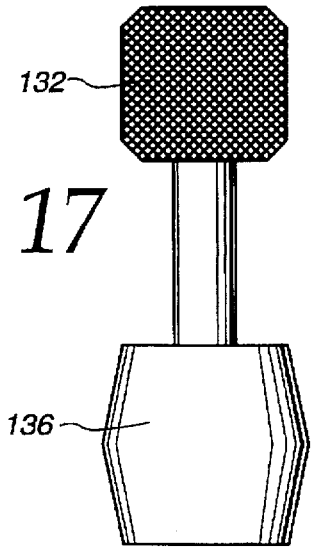

As mentioned above, the shape of the resilient body 110 is preferably cylindrical, although other shapes, such as those illustrated in FIGS. 16 and 17, are possible. FIG. 16 shows a truncated, conical shaped body 130. If desired, the toggle actuator 102 may be omitted in favor of a manually graspable knob 132. The taper of resilient body 130 is chosen so that, when the resilient body is compressed against the nozzles within the mounting block, a minimum length of contact between the resilient body and the nozzles is established as the resilient body is inserted within central aperture 80. FIG. 17 shows an alternative embodiment of a resilient body, designated at 136, which is generally barrel-shaped, comprised of back-to-back frustoconical portions. The central, major diameter of resilient body 136 is pressed against the nozzles protruding into central aperture 80. The resilient body 136 is preferably deformable under pressure so that a line contact of maximum diameter of resilient body 136 is broadened into a generally cylindrical contact area.

Figure 13:
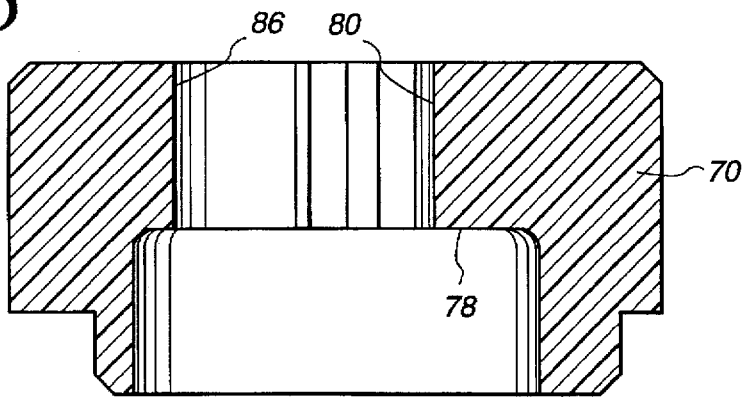
FIG. 13 is a cross-sectional view taken along the line 13—13 of FIG. 12.
Figure 14:
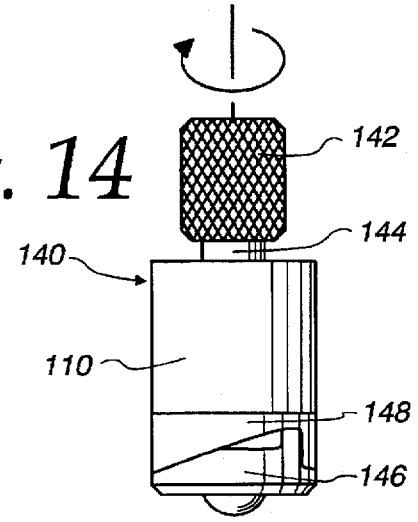
FIGS. 14–17 show alternative clamping assemblies for use with the mounting block.
Figure 15:
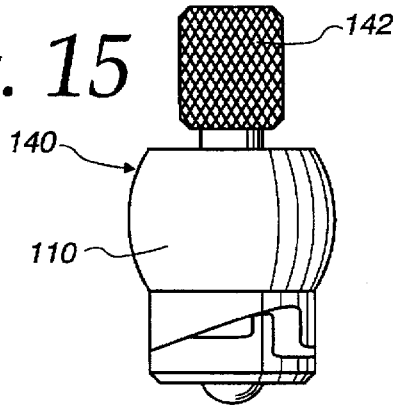

FIGS. 14 and 15 show an alternative embodiment of a clamping member generally indicated at 140. The clamping member 140 includes a conventional swell latch having a manually graspable knob 142 coupled to a shaft 144 carrying a cam member 146 which is axially fixed on a shaft 144. A cam member 148, axially movable but rotatably fixed on shaft 144, presses against resilient body 110 as cam member 146 is rotated, thereby causing the resilient body 110 to swell, as indicated in FIG. 15. The internal wall of mounting head 70 can be omitted, if desired, in the manner indicated in FIG. 13 since compression of the resilient body does not rely upon an internal wall, but rather is developed by torque forces applied to knob 142.

As mentioned, the various resilient bodies described above are inserted after the nozzles are positioned within mounting block 70, and some variations of the resilient body size and shape have already been mentioned. However, further variations are also possible. For example, the resilient bodies illustrated in FIGS. 16 and 17 require an insertion force to apply clamping pressure. This will impart a downwardly directed force component against the nozzles. If this is objectionable, the resilient body illustrated in FIGS. 10 or 14 could be employed and could be dimensioned for negligible insertion force prior to the application of compressive forces which swell or bulge the resilient bodies, in the manner illustrated in FIGS. 11 and 15, for example. A balloon-like inflatable bladder could also be used.

Still further, more exacting tolerances can be employed to achieve different operating characteristics for the mounting assembly. For example, the compliance of the resilient body, that is, the amount of swelling for a given compressive force, can be an important design factor, along with the ability of the resilient body to conform or "flow" when clamping pressure is developed. For example, if the material of the resilient body is sufficiently compliant, the resilient body can accommodate different nozzle configurations. For example, with reference to FIG. 6, the resilient body is pressed against three nozzles inserted in the nozzle block, with two of the remaining recesses 86 left unoccupied. With the addition of other nozzles, greater demands are placed upon the compliance of the resilient body. Further, the size and material selection for the resilient body can allow the same body to accommodate a single nozzle in any of the recesses formed in the mounting block, as well as any number of additional nozzles inserted in varying configurations in the remaining recesses.

It is generally preferred that the resilient bodies be made exclusively of a resilient homogeneous material, most preferably a material such as urethane or silicone, or other material having a hardness ranging between 55 and 65 Shore A durometer. However, the resilient body could comprise a combination of a harder inner core surrounded by a softer resilient outer wall. The inner core could be harder, yet compressible to some extent, or could even be relatively incompressible. As a further alternative, the resilient body could be replaced with a hollow, thick-wall, inflatable body pressurized so as to outwardly bulge. A control system could be employed for pressurizing the inflatable clamping member to a value within a preselected pressure range.

As can be seen in FIG. 6, nozzles of different cross-sectional size can be accommodated without requiring differently configured resilient bodies. One practical result is that the nozzle mounting block can accommodate nozzles having different flow rates, even with relatively constant flow velocities. For example, a formulation or recipe can call for a variety of ingredients, each dispensed through a respective nozzle, in different relative proportions.

While the proportionally larger ingredients could be provided by prolonged dispensing times, it may be preferred that the dispensing be performed on a relatively simultaneous basis, and further, it may be important to shorten the dispense cycle times. As a result, larger sized nozzles would accommodate these operating requirements, and a dispensing system of the present invention is versatile so as to handle these varying conditions with a minimum number of relatively inexpensive components. For example, the resilient bodies are "self centering" when seated in the nozzle mounting blocks, and can adjust for different nozzle configurations within the mounting block, without requiring operator adjustments.

Further, if the resilient body is made sufficiently compliant, the same resilient body can accommodate all of the permutations and combinations of nozzle arrangements within a mounting block, further simplifying the operator's task by not requiring the operator to select between different mounting components. The versatility of the dispensing system has commercial importance for a variety of different industrial applications. For example, the dispensing system may be used to dispense different formulations of food products or alternatively paint and other coating products. Typically, all of the available reservoirs are coupled to a dispense head and are available for dispensing if a particular formula currently being processed requires the ingredient filling the reservoir. While this is usually acceptable, there are situations where isolation of presently unwanted ingredients justifies additional operator involvement.

Referring to FIG. 6, for example, five recesses are provided to accommodate five different ingredients. If a formula requires less than five ingredients, the nozzles for the unwanted ingredients can be quickly and easily removed from the mounting block, thereby providing positive assurance that the unwanted ingredient will not become inadvertently mingled with the dispensed ingredients. For example, in the arrangement illustrated in FIG. 2, an operator will select the empty cans to be filled in a dispensing operation and will determine the unwanted ingredients for that operation. With removal of the resilient body from the mounting head, nozzles carrying the unwanted ingredients can be placed remote from the conveyor 42 carrying the cans to be filled. The resilient body can thereafter be reinserted, clamping nozzles for the desired ingredients in place.

The dispensing system of the present invention provides further advantages, particularly for producers of different formulations in different sized batches. As illustrated, for example, in FIGS. 3 and 4, different sized cans can be accommodated by the same dispensing system. The dispense nozzles could be made negligibly small in size compared to the size of the cans to be filled, although this would prolong the dispensing times and may introduce unwanted shear stresses at the dispense site. Accordingly, practical dispensing systems employ connecting conduits and dispensing nozzles of substantial size. Accordingly, the configuration of the dispense nozzles becomes important, especially for arrangements which accommodate substantially simultaneous dispensing cycles or for other dispensing operations where it is impractical to move a can from one dispensing nozzle to another in order to complete a formulation. With the dispensing system described herein, the nozzle orifices can be located within an area smaller than most minimum anticipated container openings.

Referring to FIG. 9, for example, it can be seen that the recesses 86 formed in mounting block 70 have a substantial axial length, sufficient to provide substantial axial alignment of nozzle tips inserted therein. It may be advantageous in some dispensing applications for the nozzles to be oriented in a true vertical direction, a condition which is readily accommodated by the various mounting assemblies described above without requiring special operator skills. Such vertical orientation of the nozzle tips can be important where it is desired to maintain the orifice of the nozzle tips in a horizontal plane so as to minimize gravitational effects on fluid adhering to the nozzle orifice. Maintaining of the nozzle orifice in a horizontal position balances the meniscus at the orifice. Although the horizontal orientation of nozzle orifices is important in some applications, other applications may not be so constrained, and further advantages may be attained by orienting the mounting assembly at angles to the horizontal. In addition, the mounting block can provide a wall, such as internal wall 82, against which a clamping force can be developed, if such is required.

An example was given above with reference to FIG. 6 for differing nozzle configurations which can be accommodated by a particular mounting block 70 having recesses for five nozzles. It should be understood that the recesses can be of a single uniform size or could be made of different sizes, as suggested in the Figure. The recess walls provide a clamping surface which cooperates with forces developed by the resilient clamping member to maintain nozzles, even those of differing size, in fixed positions. Additional versatility is provided since the mounting assembly does not require that the full complement of nozzles be installed for effective clamping. As was contemplated above, nozzles for unwanted ingredients could be removed from the mounting block before initiation of a dispensing operation. If desired, special mounting blocks unique to a given formulation can be prepared beforehand. These special mounting blocks could be configured for special combinations of nozzles, excluding the nozzles of unwanted ingredients. As a further enhancement, the shapes of the nozzles can include protrusions such as keying lugs so as to distinguish between similarly sized nozzle tips. Such keying lugs could project outwardly from the nozzle tips and complementary grooves would be provided in the mounting block adjacent the recesses for the intended nozzle tips. The keying lugs could be arranged so as to accept only a single particular nozzle tip, excluding all others.

Further, while the nozzle tips shown in FIG. 6 and other Figures are generally cylindrical, the nozzle tips could have different cross-sectional configurations. For example, the different nozzle tips could have cross-sectional shapes such as those of a triangle, trapezoid, square or rectangle, for example, with complementary shaped recesses 86 formed in a mounting block. If concerns about flow conditions for such nozzle tips arises, the internal bores for the nozzle tips could be made cylindrical, for example.

Even if the nozzle tips are made of different cross-sectional shapes, it may still be possible to accommodate such nozzle tips with the resilient bodies described above. However, the resilient bodies need not have circular cross-sectional shapes. For example, the resilient bodies could have a rectangular shape, with the central aperture having a complementary rectangular shape, if desired. The resilient bodies could have a "straight" wall as illustrated in FIG. 10, a tapered wall as illustrated in FIG. 17 or a wall having an enlarged mid-sectional size as illustrated in FIG. 17, as these concepts can be applied to resilient bodies having noncircular cross sections.

As mentioned above, it may be desirable to remove nozzle tips on a regular, frequent basis to provide a positive isolation of unwanted ingredients. However, such flexible operation can also be required for other reasons. For example, when food grade materials are dispensed, frequent regular cleaning schedules are usually imposed by internal quality control standards as well as various public regulatory bodies. With the mounting assemblies described above, the nozzles can be readily removed from the mounting block for cleaning, with their connecting tubing 32 also being made accessible for cleaning. If desired, an additional nozzle block could be installed adjacent the dispense valves 24 for cleaning purposes. For example, the additional nozzle block could be installed over a drain line or suction line to accept cleaning fluid, directing the cleaning fluid to a circulating pump, filter or other associated device. Further, it is possible to simultaneously carry out cleaning and dispensing operations if an additional mounting block is provided for this purpose.

At times, a producer may be required to dispense difficult materials, posing a substantial risk of causing a general purpose dispensing system to fail. For example, a manufacturer may be called upon to dispense a material which quickly hardens, or which quickly spoils or ages. At particular risk are the nozzles and connecting tubes 32 used to carry such difficult materials. With the mounting assembly of the present invention, a minimal investment is required for these components and these components can be quickly replaced on an individual basis. Further, the components removed may be reclaimed by soaking or other treatment carried out at a remote site.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A dispensing system for delivering a plurality of materials, comprising:

a plurality of vessels having sidewalls with upper and lower ends;

spaced-apart pairs of mounting lugs protruding from the vessels;

a support frame for receiving the vessels and for engaging the mounting lugs so as to hangingly support the vessels;

a plurality of weight indicating means for sensing the vessel weights, located between at least one of the mounting lugs of the vessels and the support frame and the weight indicating means having output means indicative of the weights sensed;

flow control means having control input means coupled to the output means of the weight indicating means, material input means for receiving material to fill the vessels and material output means for coupling the vessels and the material source;

coupling means coupling the output means of the weight indicating means and the input means of the flow control means whereby filling of the vessels is controlled in response to signals from the weight indicating means;

a body having upper and lower spaced surfaces and defining a central aperture extending between the upper and the lower surfaces and a plurality of trough-like recesses surrounding the central aperture and extending between the upper and the lower surfaces;

a plurality of dispense nozzles coupled to the vessels and having end portions at which material is dispensed, the end portions disposed in the recesses; and a resilient clamping member having an outer surface, the clamping member disposed in the central aperture and dimensioned so that portions of the outer surface engage the dispense nozzle end portions so as to clamp the dispense nozzle end portions in the body.

2. The system of claim 1 further comprising a plurality of pumps coupled between the vessels and the dispense nozzles.

3. The system of claim 2 further comprising a plurality of return conduits coupling the pumps and the vessels so as to circulate material within the vessels.

4. The system of claim 3 wherein the flow control means comprises a valve selectably operable between closed and open positions.

5. The system of claim 1 wherein the vessel sidewalls are generally cylindrical and the mounting lugs are positioned diametrically opposing one another.

6. A nozzle assembly, comprising:

a body having upper and lower spaced surfaces and defining a central aperture extending between the upper and the lower surfaces and a plurality of trough-like recesses surrounding the central aperture and extending between the upper and the lower surfaces;

a plurality of dispense nozzles having end portions at which material is dispensed, the end portions disposed in the recesses; and a resilient clamping member having an outer surface, the clamping member disposed in the central aperture and dimensioned so that portions of the outer surface engage the dispense nozzle end portions so as to clamp the dispense nozzle end portions in the body.

7. The assembly of claim 6 further comprising a compression member coupled to the body above the central aperture so as to compress and thereby bulge the clamping member to press the clamping member against the nozzle end portions.

8. The assembly of claim 7 wherein the compression member is movable toward and away from the body lower surface.

9. The assembly of claim 7 wherein the compression member is rotatable with an axis of rotation extending between the upper and the lower surfaces of the body.

10. The assembly of claim 6 wherein the central aperture is generally cylindrical and the recesses are part cylindrical.

11. A nozzle mounting assembly for mounting a plurality of dispense nozzles having end portions at which material is dispensed, the assembly comprising:

a body having upper and lower spaced surfaces and defining a central aperture extending between the upper and the lower surfaces and a plurality of trough-like recesses surrounding the central aperture and extending between the upper and the lower surfaces; and a resilient clamping member having an outer surface, the clamping member disposed in the central aperture and dimensioned so that portions of the outer surface protrude toward the recesses so as to engage dispense nozzle end portions which are disposed in the recesses, thereby clamping the dispense nozzle end portions in the body.

12. The assembly of claim 11 further comprising a compression member coupled to the body above the central aperture so as to compress and thereby bulge the clamping member, bringing the outer surface of the clamping member toward the recesses.

13. The assembly of claim 12 wherein the compression member is movable toward and away from the body lower surface.

14. The assembly of claim 12 wherein the compression member is rotatable with an axis of rotation extending between the upper and the lower surfaces of the body.

15. The assembly of claim 11 wherein the central aperture is generally cylindrical and the recesses are part cylindrical.

16. A fill control system, comprising:

a vessel having a sidewall with upper and lower ends;

a spaced-apart pair of mounting lugs protruding from the vessel;

a support frame for receiving the vessel and for engaging the mounting lugs so as to hangingly support the vessel;

weight indicating means for sensing the vessel weight, located between at least one of the mounting lugs and the support frame and the weight indicating means having output means indicative of the weight sensed;

a material source of material to fill the vessel;

flow control means having input means and coupling the vessel and the material source;

coupling means coupling the output means of the weight indicating means and the input means of the flow control means whereby filling of the vessel is controlled in response to signals from the weight indicating means.

17. The system of claim 16 wherein the mounting lugs are positioned on opposite sides of the vessel and provide the sole support of the vessel.

18. The system of claim 17 wherein the vessel sidewall is generally cylindrical and the mounting lugs are positioned diametrically opposing one another.

19. The system of claim 16 wherein the flow control means comprises a valve selectably operable between closed and open positions.

20. The system of claim 16 wherein the weight indicating means comprises a strain gauge positioned under one of the mounting lugs.

* * * * *